United States Patent [19]

Pearson

[11] 3,942,200

[45] Mar. 9, 1976

[54] ODOR CONTROL VENTILATOR

[76] Inventor: Raymond H. Pearson, 627 Sherwood Drive, Richardson, Tex. 75080

[22] Filed: Jan. 13, 1975

[21] Appl. No.: 540,538

[52] U.S. Cl. ..... 4/213; 4/72
[51] Int. Cl.[2] ..... E03D 9/04; A47K 13/00
[58] Field of Search ..... 4/216, 213, 217, 218, 167, 4/211, 209, 140, 103, 105, 106, 72, 83; 200/83 V, 83 W, 83 R; 357/26

[56] References Cited

UNITED STATES PATENTS

| | | | |
|---|---|---|---|
| 2,105,794 | 1/1938 | Norris | 4/213 |
| 2,949,615 | 8/1960 | Farrell | 4/211 |
| 3,087,168 | 4/1963 | Huso | 4/213 |
| 3,192,539 | 7/1965 | Martz | 4/218 |
| 3,302,269 | 2/1967 | Cooper et al. | 200/83 R |
| 3,321,594 | 5/1967 | Reise et al. | 200/83 V X |
| 3,495,282 | 2/1970 | Taggart | 4/213 |
| 3,535,480 | 10/1970 | Bahniuk | 200/83 V |
| 3,626,554 | 12/1971 | Martz | 4/213 |
| 3,638,481 | 2/1972 | Wilner | 357/26 X |
| 3,681,790 | 8/1972 | Dooley | 4/216 |
| 3,703,010 | 11/1972 | Russell | 4/216 |
| 3,720,963 | 3/1973 | Zakaski | 4/167 |
| 3,763,505 | 10/1973 | Zimmerman | 4/213 |
| 3,824,358 | 7/1974 | Edwards et al. | 200/83 V |

*Primary Examiner*—Henry K. Artis

[57] ABSTRACT

A ventilator for toilets is disclosed which includes an electrically operated blower and an exhaust conduit for withdrawing odors from the toilet bowl through the flush water distribution outlets within the bowl, and through the overflow pipe within the water tank.

Special electrically operated air valves, and special electrical controls are provided so that one central system may effectively remove emission odors from all of the toilets within a household. The combination of air valves and electrical switches provides completely independent ventilation of each toilet although only one blower is normally employed.

The special valves of this invention provide the unique function of repressurizing the water tank at the moment the toilet is flushed. A unique switching device is provided for the control of the valves.

11 Claims, 13 Drawing Figures

ODOR CONTROL VENTILATOR

CROSS REFERENCE TO RELATED APPLICATION

This invention is suitable for use in conjunction with any of the various ventilating means for connecting into the water tank taught in my pending application Ser. No. 496,954, filed Aug. 13, 1974, of which this application is a continuation-in-part Application Ser. No. 496,954, is in turn a continuation-in-part of Ser. No. 434,519 filed Jan. 18, 1974.

BACKGROUND OF THE INVENTION

1. Field of the Invention

This invention relates to an improved ventilator system for removing odor laden air from toilet bowls through the overflow pipe of the toilet water tank, and more particularly to a ventilator system in which a single electrically operated blower and an air intake manifold are connected to the water tanks of a plurality of toilets within a household by branch conduits and by special electrically operated air valves so that one central system may effectively remove the odor laden air from all of the toilets.

2. Description of the Prior Art

Systems have been previously disclosed for ventilating a plurality of toilets using a single blower and a common intake manifold. The following U.S. Pat. Nos. are illustrative:

1,362,290

2,743,462

U.S. Pat. No. 1,362,290 provides a normally closed single valve in the air intake manifold adjacent a blower which isolates the intake manifold from the blower at all times except when one or more parallel connected switches at the toilets are closed to energize a magnet for actuating the valve. The valve has a valve stem on which is an abutment which engages a blower switch as the valve is opened to turn on the blower for applying a vacuum to the manifold for ventilating all of the toilets connected to the manifold simultaneously. In contrast to the teaching of U.S. Pat. No. 1,362,290 the present invention provides separate valve means for isolating each toilet from the ventilator intake manifold. Furthermore U.S. Pat. No. 1,362,290 teaches the connection of the ventilator directly to the toilet bowl whereas the present invention connects the ventilator to the toilet bowls through the overflow pipe in the toilet water tank.

U.S. Pat. No. 2,743,462 teaches providing separate air valves at each toilet for isolating each toilet from a ventilator air intake manifold independently of the other toilets, and independent control means at each toilet for energizing the ventilator fan and opening only the air valve associated with the particular toilet in use. U.S. Pat. No. 2,743,462 in contrast to the present invention connects the ventilator to the toilet bowl directly rather than ventilating through the overflow pipe in the toilet water tank. Also the air valve and control disclosed by U.S. Pat. No. 2,743,462 are substantially different from those provided in the present invention.

The present invention is an advantage over the aforementioned prior art in at least several ways:

1. It provides for completely independent operation of a central ventilator from any toilet within the dwelling, whether or not other toilets are being used simultaneously, and is of the more desirable type which ventilates through the overflow pipe. 2. It provides for the automatic control of the blower and air valves at the moment the toilet is flushed, resulting in the immediate repressurization of the water tank at this time, so as not to retard the flow of water into the bowl. This of course is very important to the satisfactory operation of the toilet, and to the marketing of the product.

3. The unique air induction nozzle employed allows relatively simple installation, and user control over the volume of air flowing through the toilet.

4. The unique valve arrangement prevents the continual buildup of water condensation within the blower system.

SUMMARY OF THE INVENTION

It is an object of this invention to provide an improved means of ventilating all of the toilets within a dwelling from one central system.

It is another object of this invention to provide independent control of the ventilation of each toilet, the ventilator being of the type which draws odor laden air through the overflow pipe within the water tank.

It is another object of this invention to provide for the automatic stopping of the ventilator when the toilet is flushed.

It is still a further object of this invention to provide an adjustable means, convenient to the person using the toilet, for regulating the volume of air flowing through the toilet.

It is yet another object of this invention to cause the toilet water tank to be repressurized quickly when the ventilation is stopped.

It is still another object of this invention to provide protection of the blower against harmful water condensation when said blower is not in use.

It is a further object of this invention to control the special air valves by means of a switch connected directly or through mechanical or magnetic linkage to the flush handle on the water tank.

It is a further object of this invention to control the special air valves by means of an air sensitive switch.

BRIEF DESCRIPTION OF THE DRAWINGS

With the foregoing objects and features in view and such other objects and features which may become apparent as this specification proceeds, the invention will be understood from the following description taken in conjunction with the accompanying drawings, in which like characters of reference are used to designate like parts and in which.

DESCRIPTION OF THE PREFERRED EMBODIMENTS

Figure 11:
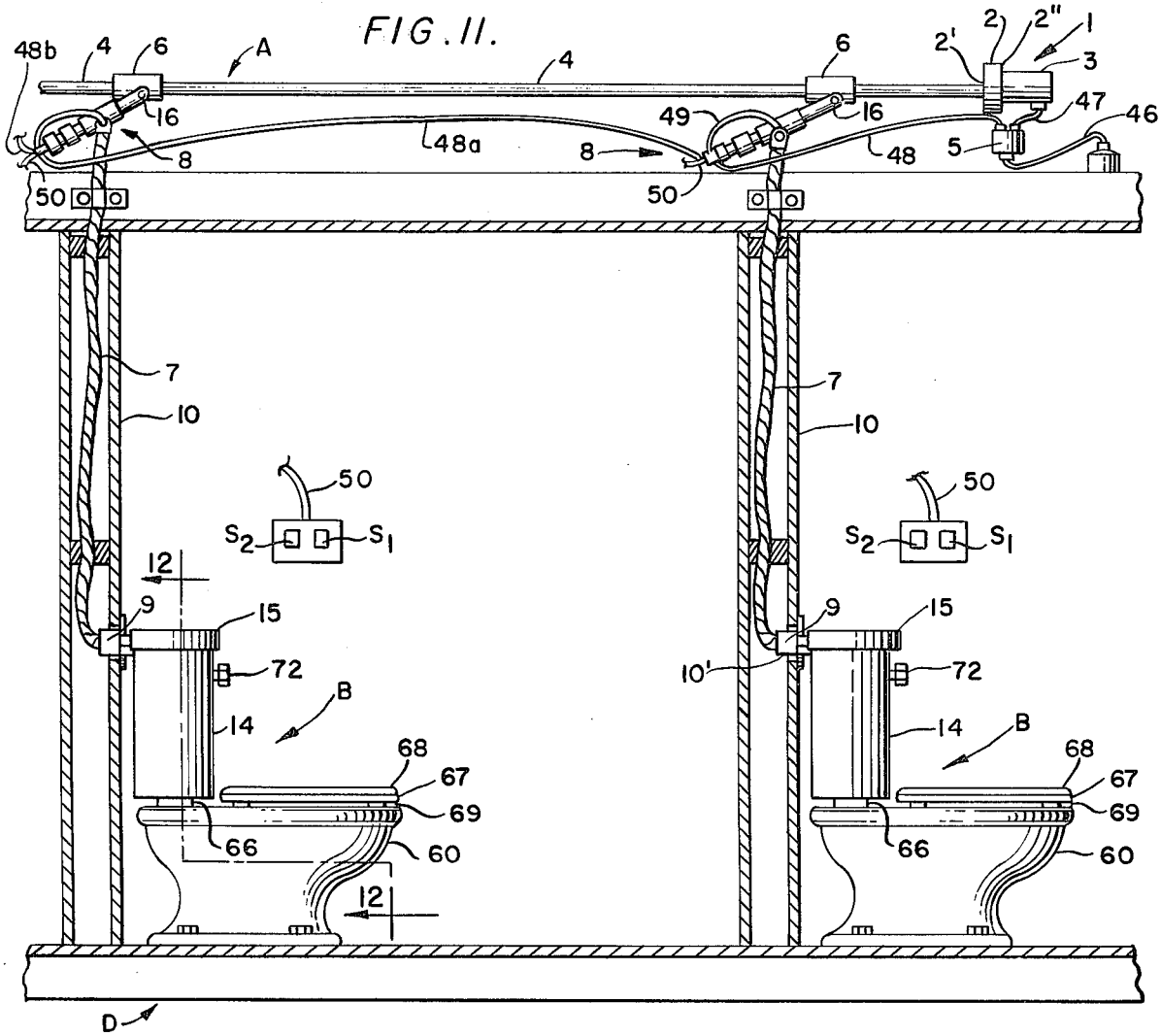
FIG. 11 is a partial sectional view of a building showing in elevation multiple toilets and a ventilator system for the toilets in accordance with this invention.
Figure 12:
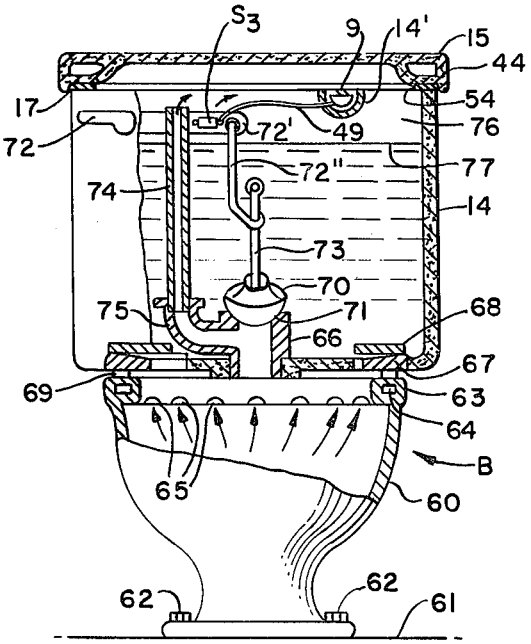
FIG. 12 is a partial sectional view taken generally along line 12 — 12 in FIG. 11 of a toilet of the type for which this invention is particularly well adapted for use.

Referring to FIGS. 11 and 12 of the drawings the toilet deodorizing accessory A of this invention is shown in combination with a pair of toilets B, B located in separate rooms of a dwelling D. While only two toilets are shown in FIG. 11 it will be understood that additional toilets may be connected to the deoderizing accessory A in the same manner as the toilet B, B. Further, although the invention is particularly adapted for use in ventilating multiple toilets, it may be used to ventilate a single toilet. Each of the toilets B, B are of a conventional type including a bowl 60 and a water tank 14. The toilet bowl 60 is conventionally bolted to a floor 61 by bolts 62. The top of the toilet bowl 60 includes a hollow rim 63 which defines an annular chamber 64 for distribution of water through holes 65 about the bottom edge of the hollow rim 63. The water tank 14 is seated on the rear of the bowl 60 and is connected by means of a pipe 66 to a mating aperture (not shown) in the hollow rim. In front of the water tank 14 are provided the usual toilet seat 67 and seat cover 68. The customary cushion members 69 are attached to the underside of the seat 67 to separate the bottom of the seat from the top of the toilet rim 63. Inside the water tank 14 are provided the customary fittings (for clarity only partially shown) including a bulb valve 70 seated on the valve seat 71 at the upper end of the flush pipe 66. The bulb valve 70 is adapted to be lifted upon manual operation of the flushing handle 72 which is operatively connected by conventional linkages 72', and 72'' with the valve stem 73. An overflow pipe 74 extends from a branch line 75, connected to the flush pipe 66 beneath the bulb valve 70, to the space or chamber 76 at the top of the tank 14 between the tank cover 15 and the normal water level 77 within the tank 14 prior to flushing. It will be understood that the water tank 14 also includes the usual inlet pipe, inlet valve, float and connecting linkage for operating the inlet valve in response to the rise and fall of the float when the water level in the tank 14 changes. A sealing gasket 17 is provided between the underside of the tank cover 15 and the top edge of the water tank to form an air tight seal. An aperture 14' is provided at the rear of the tank 14 adjacent its upper edge to receive an air nozzle 9, closely fitted therein, which forms a part of the toilet deodorizing accessory A of this invention now to be described.

The toilet deodorizing accessory A of this invention is shown in combination with plural toilets within a dwelling in FIG. 11 and is shown in greater detail in FIGS. 1 — 10. A blower 1 comprised of a fan 2 having suction and discharge sides 2', 2'' respectively and an electric motor 3 is connected to a manifold 4 by the suction side 2' of the fan 2 so that when the blower 1 is operating, a vacuum is created within the manifold 4. The blower 1 and manifold 4 may be located in the attic of a dwelling as shown in FIG. 11 or in some other remote location such as the basement. The manifold 4 is preferably a rigid polyvinyl chloride plastic tube of the type employed in built-in vacuum cleaner systems usually having an inside diameter of 1 and ⅝ inches. Conduits of other suitable materials and sizes may also be used for the manifold 4 which is run to the vicinity of each toilet to be ventilated. If so desired, an existing built-in vacuum cleaner blower may provide the suction, although a quieter blower with an optimum pressure volume curve may be preferred. The manifold 4 includes branch connector means 6 near each toilet B for connecting the manifold to branch air ducts 7. The branch air ducts 7 are each preferably a flexible plastic tube which is run inside of the wall 10 behind each toilet B in the manner described in my aforementioned patent application Ser. No. 496,954 filed Aug. 13, 1974. One end of each air duct 7, integrally or separately connected to a nozzle 9, is fitted to the toilet water tank 14 in the manner previously described. The other end of each air duct 7 is connected to a special air valve means 8 which in turn is connected to a branch connector means 6 for independently controlling the ventilation of each toilet B. The branch connector means 6 are preferably tee connectors of polyvinyl chloride, or other suitable material, of the type employed in built-in vacuum cleaners.

Figure 2:
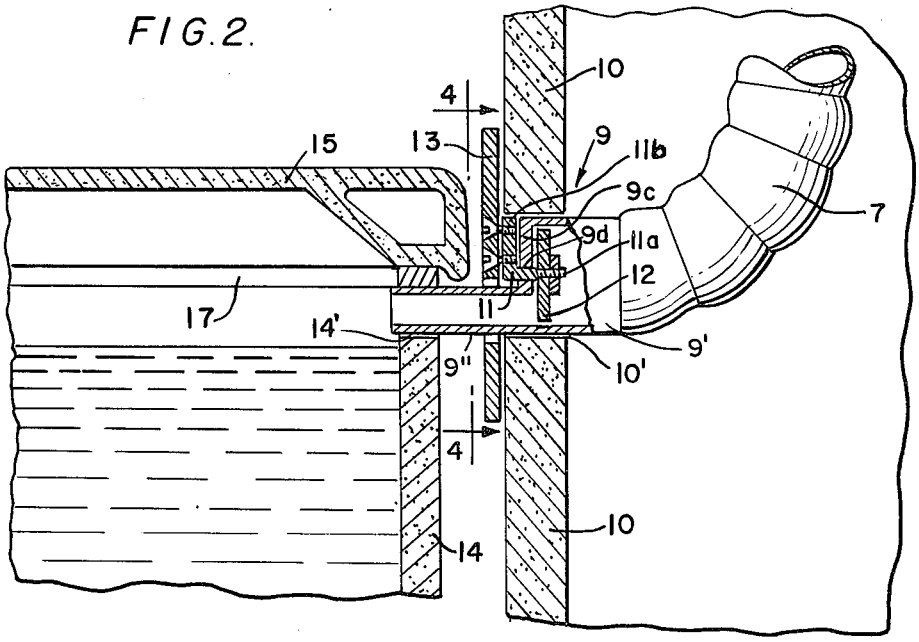
FIG. 2 is a sectional view of a portion of a toilet water tank with an air nozzle shown partly in section and partly in elevation projecting through a hollow wall into the water tank, and with a portion of the branch conduit, shown in elevation, for connecting the air nozzle to the manifold shown in FIG. 1.
Figure 3:
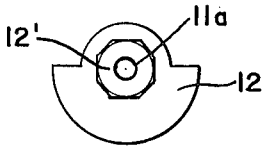
FIG. 3 is an end elevational view of the rotary valve enclosed within the air nozzle shown in FIG. 2.
Figure 4:
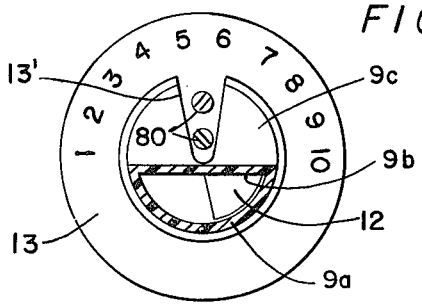
FIG. 4 is a sectional view taken on line 4 — 4 of FIG. 2.

The air nozzles 9 are of an improved type which may be employed in lieu of the various types disclosed in my aforementioned patent application. It will be observed by referring to FIG. 2 that each nozzle 9 has a cylindrical end portion 9' fitted closely within a cylindrical aperture 10' cut in the wall 10, and a reduced end portion 9'' protruding outwardly from the wall 10 and into the aperture 14' cut in the toilet water tank 14. The cross section of the reduced end portion 9'' is defined on its bottom side by an arc **9*a* of a circle, which will be normally less than 180°, and on its upper side by a horizontal chord 9*b* (see FIG. 4). The end of the cylindrical portion of the nozzle 9 above the reduced end portion 9'' is closed by an end wall 9*c* while the opposite end of the cylindrical portion is open and is suitably joined to an air duct 7. A hole 9*d* is provided through the end wall 9*c* on about the axis of the cylindrical portion 9' within which a special L-shaped bracket 11 is installed as shown in FIG. 2. The bracket 11 has a generally horizontal shaft portion 11a which extends through the hole 9*d* and a right angled leg portion 11b extending radially outwardly from the shaft portion 11*a*. A substantially semicircular vane 12 is attached to the screw threaded end of the shaft portion 11*a* of the bracket 11 and is secured thereon by a nut 12'. A calibrated wheel 13 is attached to the radially extending leg portion 11b of the bracket 11 outwardly of the wall 10 by screws 80 which extend through counter sunk holes in the finger portion 13'** of the wheel 13 into threaded bores in the leg portion 11b of the bracket 11. Rotation of the wheel 13 will rotate the vane 12 so that the vane moves to open or close the nozzle end 9'' to a preselected degree depending on the position of the wheel 13. When the numeral 1 on the calibrated wheel 13 is in the 12 o'clock position, the vane 12 will be in its maximum closed position and when the numeral 10 is in the 12 o'clock position, the vane will be in its maximum open position. Thus, the vane 12 may be rotated by the wheel 13 so as to provide the preselected flow of air desired by the user of the toilet B. In case the water tank 14 or its cover 15 is touching the wall 10, the wheel 13 may be omitted, in which case the vane 12 is adjusted by means of the bracket 11 so as to provide a vacuum within the water tank of 1 to 2 inches of water, which will usually cause a quite satisfactory air flow of about 10 to 15 cubic feet per minute.

Air nozzle 9 is similar to one described in the aforementioned patent application, with the exception that the portion of the previous nozzle which entered the water tank 14 was semicircular in cross section. Inasmuch as shaft 11 should be on about the axis of the nozzle 9, the protrusion of the current device would normally be less than semicircular. The previous advantages and simplicity of installation prevail in the improved device. To install, a diamond core bit having an outside diameter the same or slightly larger than the nozzle 9 is employed. The tank 14 is cut so that the flat upper side of the nozzle 9 is congruent with the upper edge of the tank 14. A seal 17, between the tank 14 and its cover 15, is normally provided. After the tank 14 is cut, the core bit then cuts a circular hole through the wall 10, as described in the preceeding patent application.

Figure 1:
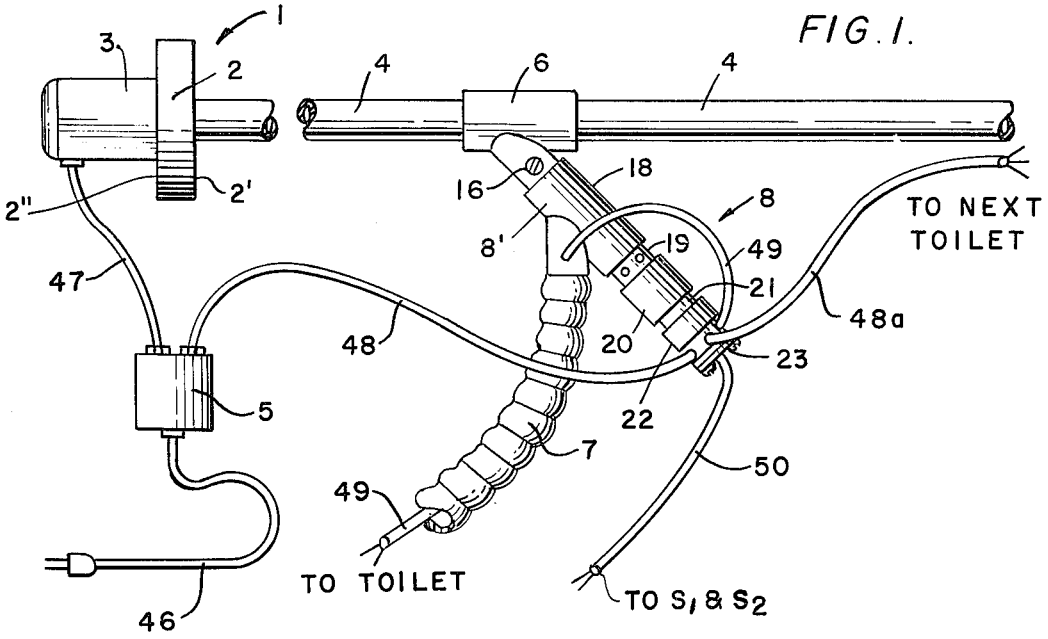
FIG. 1 is an elevational view of portions of the ventilator accessory of this invention showing a blower, an air intake manifold, a portion of a branch conduit, an air control valve in the branch conduit, and electrical wiring and controls.

Should it be desired to employ another nozzle arrangement, or one of the techniques taught in the art for connecting directly to the overflow pipe, it is recommended that a butterfly valve (not shown) be installed in the tee 6 just ahead of valve 8, in order to control the air flow and tank pressure. A screwdriver adjustment 16 is shown in FIG. 1 for the purpose of adjusting such a butterfly valve.

Figure 5:
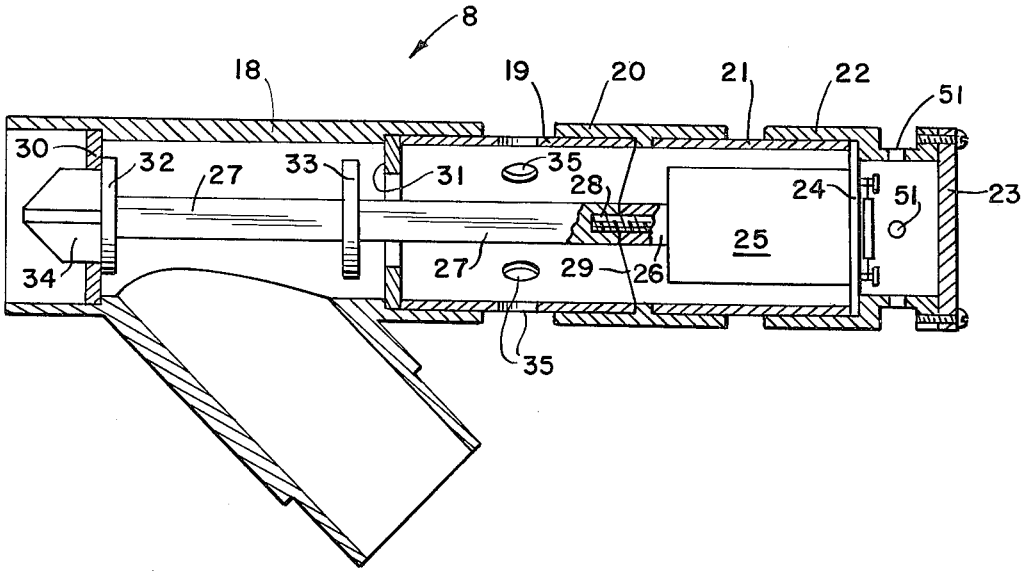
FIG. 5 is a partial longitudinal sectional and elevational view of the special air valve used in this invention.
Figure 6:
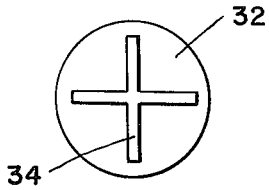
FIG. 6 is a left hand end view of the valve head and valve guide shown in FIG. 5.

The preferred embodiment of the special air valve 8 is shown in FIG. 5. The housing 8' is manufactured from standard tubing and fittings of the type used in the installation of builtin vacuum cleaners. A tee 18, nipple 19, coupling 20, nipple 21, adapter 22, and cover 23 comprise the complete housing, the parts being bonded with cement or a suitable PVC solvent. A phenolic bulkhead 24 provides for mounting the solenoid field coil and pole piece 25, together with the necessary electronic components as described below. The solenoid plunger 26 is fastened to the valve push rod 27 by a small threaded stud 28. A flexible neoprene diaphragm 29 seals the solenoid from dirt and water condensation. A front valve seat 30, and rear valve seat 31 are provided. A front valve 32 and rear valve 33, carried by push rod 27, are also provided. A deeply grooved guide 34 insures that the forward valve 32 remains centered, the solenoid plunger 26 maintaining the alignment at the other end. FIG. 6 is a front view of the valve 32, together with the integrally molded guide 34.

When the ventilator is not in use, the solenoid 25 is deenergized and valve 32 is closed, while valve 33 is open as shown in FIG. 5, by virtue of a compression spring (not shown) located within the solenoid which forces the plunger out as shown. A plurality of holes 35 in the nipple 19, together with the normally-open valve 33, allow the air duct 7 to be vented to the atmosphere, insuring completely normal toilet flushing operation. The normally-closed valve 32 insures that the air duct 7 is sealed off from the manifold 4. This is important for two reasons, i.e., another toilet may be in use and ventilated, in which case the blower 1 is running, also the blower is sealed off and protected from the continual condensation emerging from the unused toilets, which is far greater than when the ventilator is in operation. The condensate is free to flow back into the water tank, or to evaporate through the holes 35 into the atmosphere.

When an individual toilet ventilator is placed in use, the solenoid 25 is energized thus pulling the plunger 26 and push rod 27 which closes valve 33, and opens valve 32. This of course seals the air duct 7 from the atmosphere, and connects it to the manifold 4, causing a suction within the water tank, and the flow of odor laden air from the toilet. The odor laden air emerges from the blower 1 to be disbursed into the atmosphere in any convenient manner.

When a toilet is flushed, an electronic system subsequently to be described causes solenoid 25 to deenergize immediately. By virtue of the aforementioned spring within the solenoid 25, valve 32 closes thus isolating the air duct 7 from the manifold 4, and valve 33 opens thus repressurizing the air duct 7 and water tank 14, enabling completely normal flushing operations of the toilet. Without the valve 33, the water tank 14 would repressurize so slowly that the flushing cycle would be retarded to the point of being ineffective.

Figure 7:
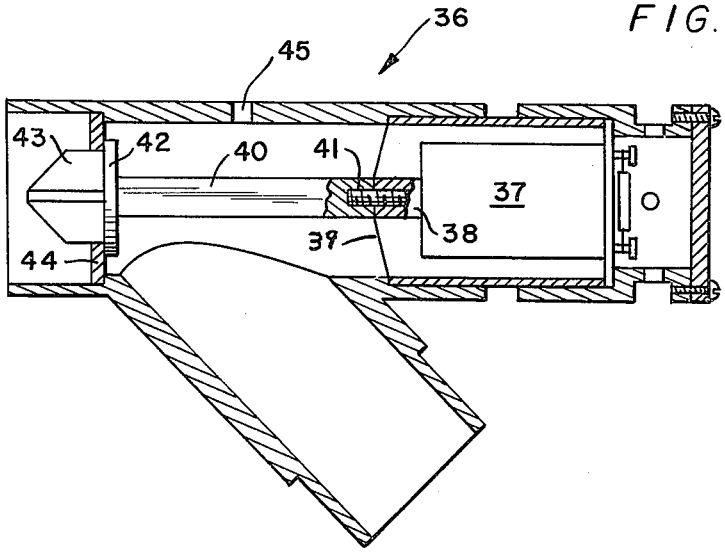
FIG. 7 is a partial longitudinal sectional and elevational view of a modified air valve used in this invention.

A somewhat smaller and less expensive valve means 36 is portrayed in FIG. 7. Here a solenoid 37, plunger 38, diaphragm 39, push rod 40, threaded stud 41, normally-closed valve 42, guide 43, and valve seat 44 are provided as in the valve 8. However, a hole 45 has been provided in lieu of valve 33 and seat 31 (FIG. 5). Thus, the air duct 7 and water tank 14 are vented continuously through the hole 45, which allows normal use of the toilet. Assuming that the blower 1 is running, when the toilet is flushed the electronic circuits below deenergize the solenoid 37, and the valve 42 closes. The air duct 7 and water tank 14 repressurize through the hole 45, not as quickly as in the case of valve means 8 but nevertheless, the repressurization is prompt. Hole 45, which is in reality a calibrated air leak, may be located anywhere on the toilet side of the valve 42, but since some noise is generated by the air flowing through the hole 45, it is best located on or near the valve means 36 which is normally located in the attic or under the floor. The blower 1 must have additional capacity for use with this valve means 36, owing to the amount of air flowing through the calibrated hole 45. This type of valve 36 is especially suitable for the type of ventilator in which the air duct connects directly into the overflow pipe, inasmuch as the calibrated air leak 45 may be quite small since only the air duct 7 and overflow pipe are vented.

It must be understood that other types of suitable electrically operated air valves, which satisfy the techniques taught above, could be designed by those skilled in the art. Separate valves may be employed for coupling and repressurization if so desired.

Figure 8:
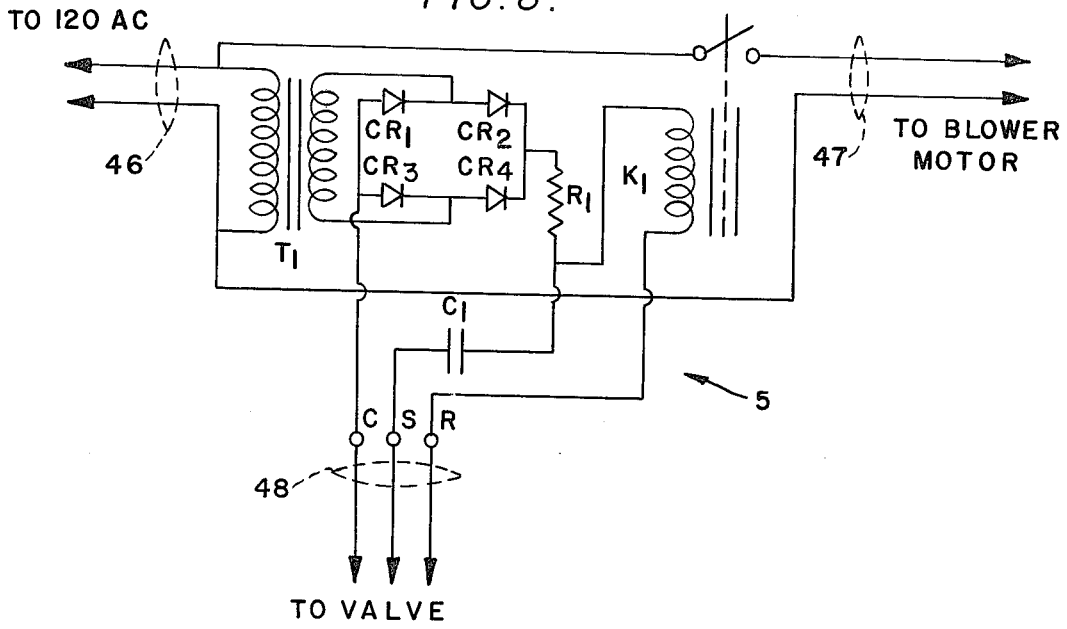
FIG. 8 is an electrical schematic diagram showing the electrical components within the motor controller of this invention.

A motor controller 5 for the blower motor 3 is shown schematically in FIG. 8. This package contains a low voltage D.C. power supply comprised of a transformer $T_1$, rectifiers $CR_1$, $CR_2$, $CR_3$, and $CR_4$, resistor $R_1$, and capacitor $C_1$. This provides power to close motor starting relay $K_1$, and all electrical valves used in the system, i.e., normally one solenoid 25 for each toilet. A cable 46 connects the controller 5 to any convenient 120 volt A.C. outlet. Cable 47 connects the controller 5 to the blower motor 3, and cable 48 connects to the closest valve means 8 in the system. The next valve down the manifold 4 is connected by means of cable 48a, which is in parallel with cable 48 at terminals C, S, and R within the valve housing 8'.

Figure 9:
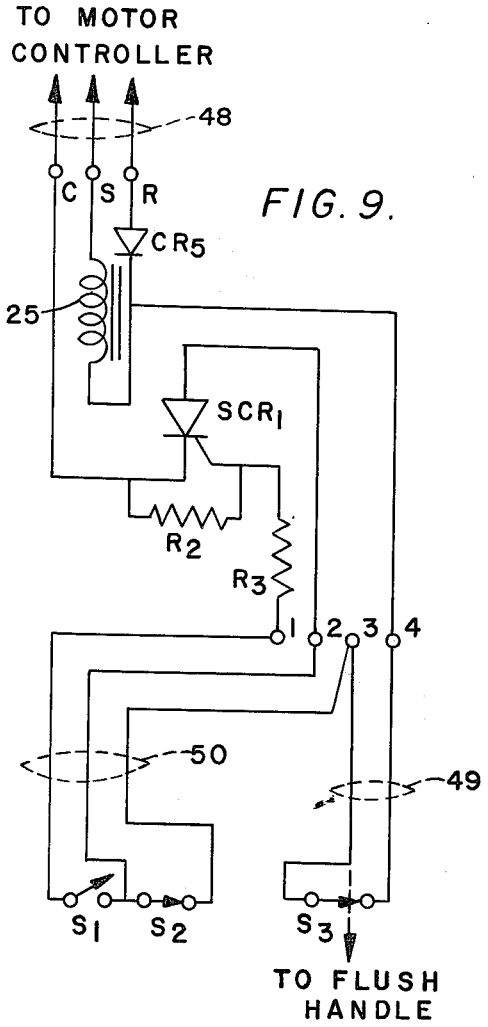
FIG. 9 is an electrical schematic diagram which together with the electrical diagram of FIG. 8 illustrates a preferred electrical ventilator control system in accordance with this invention.

FIG. 9 portrays schematically the electronic circuit associated with the valve means 8. The components $CR_5$, $SCR_1$, $R_2$, and $R_3$ are mounted on bulkhead 24, FIG. 5. Switch $S_1$ is preferably a normally-open push button switch, and $S_2$ a normally-closed push button switch. $S_1$ and $S_2$ are preferably wall mounted conveniently near the toilet to be ventilated. Switch $S_3$ is a normally-closed switch located on the inside of the water tank, and mechanically or magnetically actuated by the flush handle, or any of the mechanism operated therefrom. A very satisfactory arrangement has been to secure a mercury switch to the lever extending from the flush handle to the ball cock, which is found on most toilets. Mechanical or magnetic types of switches are also satisfactory, but more expensive to install. A cable 49 connects switch $S_3$ to the valve means 8, and is run inside the air duct 7 as shown in FIG. 1. A cable 50 connects switches $S_1$ and $S_2$ to the valve means 8. Cables 48, 48a, 49, and 50 enter the valve housing through a plurality of holes 51, FIG. 5.

When so desired, a selected toilet may be ventilated by momentarily closing switch $S_1$, which causes thyrister $SCR_1$ to conduct, thus energizing the solenoid 25, which opens valve 32 and closes valve 33, also energizing relay $K_1$ causing the blower 1 to start. This process of course reduces the pressure within the manifold 4 and air duct 7 to the selected toilet to below atmospheric, and air flows through the toilet, carrying odors to the blower. The blower 1 may be stopped manually by momentarily opening switch $S_2$, or automatically by flushing the selected toilet, which momentarily opens switch $S_3$. The momentary opening of switch $S_2$ or $S_3$ causes thyrister $SCR_1$ to cease conducting, thus deenergizing solenoid 25. Relay $K_1$ will also deenergize and stop the blower 1 unless another toilet is in use, in which case the relay $K_1$ remains energized until the last toilet in use is flushed, or switch $S_2$ of the last toilet in use is momentarily opened. Rectifier $CR_5$ insures that the solenoid 25 of one toilet will not be energized by the operation of relay $K_1$ by another toilet.

Figure 10:
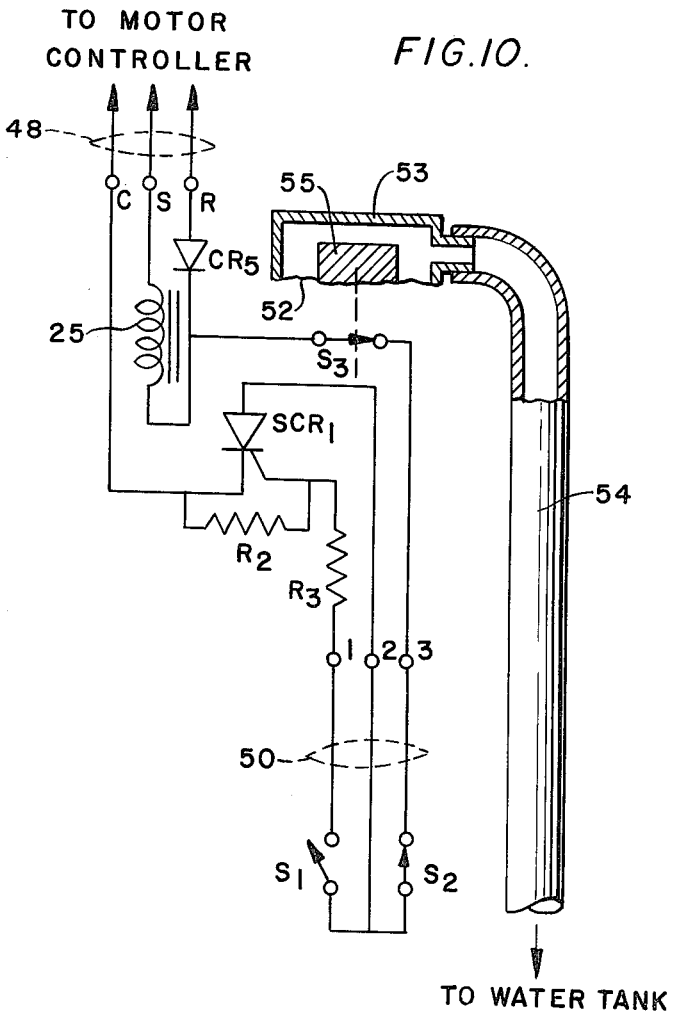
FIG. 10 is an electrical schematic diagram of circuit elements which may be substituted for the circuit elements shown in FIG. 9.

FIG. 10 portrays an alternate arrangement for operating switch $S_3$. Here a diaphragm 52 is bonded to a housing 53 which is sealed except for the connection to a small plastic tube 54, which is run into the water tank in place of cable 49, so as to sense the tank air pressure. A weight 55 insures that switch $S_3$ remains normally-closed until the vacuum within the water tank 14 exceeds a predetermined level, for example, three inches of water. Upon flushing the toilet the overflow pipe 74 is suddenly flooded, blocking the flow of air. At this time the air pressure P drops considerably under the influence of the blower 1, and the weight 55 is lifted, which momentarily opens switch $S_3$. A spring may be substituted for the weight 55 if so desired, although the dead weight method requires no calibration. The use of an air sensitive switch has the advantage that if the ventilator is restarted before the tank 14 has refilled, it will turn off again automatically. The system portrayed by FIG. 9 will make gurgling noises if the ventilator is restarted before the tank has refilled. This is due to water flowing through the same channels as the air. Instead of a pressure sensing switch, an air flow sensing switch (not shown) may be employed, since the air flow drops substantially when the toilet is flushed. Flow sensing switches are commercially available, as are pressure sensing switches.

If so desired a gasket seal may be installed between the toilet seat 67 and the top of the bowl 63, in which case a smaller blower may be used. However, the seal is not esthetically desirable and is difficult to keep clean and sanitary. Switch $S_1$ may be located on and operated by the toilet seat 67 when sitting upon it, but again is esthetically undesirable, and unsanitary.

It should be understood that while the flush responsive switch $S_3$ shown in FIGS. 9 and 10 is described as controlling both an air valve and a blower, it is within the scope of this invention that the flush responsive switch may be used in ventilator systems having a ventilator blower without the air valve inorder to stop the blower whenever a toilet is flushed.

Figure 13:
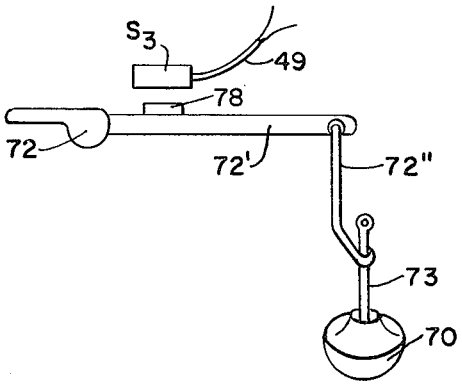
FIG. 13 is a diagramatic view showing an alternative arrangement for operating a flush controlled switch.

FIG. 13 portrays an optional magnetic method of operating switch $S_3$. The flushing handle 72, lever 72', linkage 72'', rod 73, and ball cock 70 are the same as in FIG. 12. A normally closed magnetic reed switch $S_3$ is cemented to the inside wall of the water tank 14 above the water line 77. This type of switch is commercially available, and is commonly actuated by bringing a permanent magnet near the proper side of the switch housing. A magnet 78 is suitably attached to the lever 72' so that when the toilet is flushed, the magnet 78 will be carried by the lever 72' to the vicinity of the switch $S_3$, causing it to open. This of course causes the thyrister $SCR_1$, shown in FIG. 9, to cease conducting as described above.

While in the foregoing there have been described and shown a preferred embodiment of the invention and several modifications of element thereof, various other modifications and equivalents may be resorted to within the scope of the invention as claimed.

What is claimed is:

1. A toilet deodorizing accessary for use in combination with one or more toilets, said toilets each including a convenional water tank, water tank cover, and toilet bowl, said water tank having a water discharge conduit through the bottom of the tank, a flushing means including a flush valve controlling the flow of water from the tank into said conduit, and an overflow pipe connected into said discharge conduit below the flush valve, said toilet bowl having a water distribution channel in communication with said discharge conduit for distributing water from said water tank into said bowl when said flush valve is operated to flush said bowl, said accessary comprising an air duct for each toilet suitably connected into the air space within the water tank, a seal means between said water tank and said cover, an electrically driven blower means having a suction side and a discharge side, at least one electrically operated air valve means for each toilet, said air valve means having a first part interconnecting the air duct and suction side of said blower, being capable of selectively opening or closing said interconnection, said first part operable to reduce the air pressure within the air duct and water tank, said air valve means also having a second part operable to vent the water tank to the atmosphere, being capable of selectively opening or closing said vent, an electrical control means for each toilet operable to apply electrical power to the air blower, open the first part of said air valve means, and close the second part of said air valve means, thus causing the air pressure within the water tank to be reduced below atmospheric pressure, whereby odor taken air may be drawn by said blower in seriatim from said toilet bowl, through said water distribution channel, said water discharge conduit, said overflow pipe, said air duct, the first part of said air valve means, and through said blower, said electrical control means also operable so as to remove power from said air blower, close the first part of said air valve means, and open the second part of said air valve means, thus allowing the air pressure within the water tank to return to atmospheric pressure, whereby the toilet is restored to conventional operation.

2. The accessary according to claim 1 together with a second electrical control means actuated by said flushing means, operable so as to remove power from said air blower, close the first part of said air valve means, and open the second part of said air valve means, thus allowing the air pressure within the water tank to return to atmospheric pressure, whereby the toilet is restored to conventional operation.

3. The accessary according to claim 1 together with a second electrical control means actuated by an air sensitive actuator means, operable so as to remove power from said air blower, close the first part of said air valve means, and open the second part of said air valve means, thus allowing the air pressure within the water tank to return to atmospheric pressure, whereby the toilet is restored to conventional operation.

4. A toilet deodorizing accessary for use in combination with one or more toilets, said toilets each including a conventional water tank, water tank cover, and toilet bowl, said water tank having a water discharge conduit through the bottom of the tank, a flushing means including a flush valve controlling the flow of water from the tank into said conduit, and an overflow pipe connected into said discharge conduit below the flush valve, said toilet bowl having a water distribution channel in communication with said discharge conduit for distributing water from said water tank into said bowl when said flush valve is operated to flush said bowl, said accessary comprising an air duct for each toilet suitably connected into the air space within the water tank, a seal means between said water tank and said cover, an electrically driven blower means having a suction side and a discharge side, an electrically operated air valve means for each toilet, said air valve means interconnecting the air duct and suction side of said blower, being capable of selectively opening or closing said interconnection, operable to reduce the air pressure within the water tank, a vent means located between said air valve means and said water tank, being capable of venting the water tank to the atmosphere when said air valve is closed, an electrical control means for each toilet operable to apply electrical power to the air blower and open said air valve, thus causing the air pressure within the water tank and overflow pipe to be reduced below atmospheric pressure, whereby odor laden air may be drawn by said blower in seriatim from said toilet bowl, through said water distribution channel, said water discharge conduit, said overflow pipe, said air duct, and through said blower, said electrical control means operable so as to remove power from said blower and close said air valve means, thus allowing the air pressure within the water tank to return to atmospheric pressure, whereby the toilet is restored to conventional operation.

5. The accessary according to claim 4 together with a second electrical control means actuated by said flushing means, operable so as to remove power from said air blower, and close said air valve means, thus allowing the air pressure within the water tank to return to atmospheric pressure, whereby the toilet is restored to conventional operation.

6. The accessary according to claim 4 together with a second electrical control means actuated by an air sensitive actuator means, operable so as to remove power from said air blower, and close said air valve means, thus allowing the air pressure within the water tank to return to atmospheric pressure, whereby the toilet is restored to conventional operation.

7. A toilet deodorizing accessary for use in combination with one or more toilets, said toilets each including a conventional water tank, water tank cover, and toilet bowl, said water tank having a water discharge conduit through the bottom of the tank, a flushing means including a flush valve controlling the flow of water from the tank into said conduit, and an overflow pipe connected into said discharge conduit below the flush valve, said toilet bowl having a water distribution channel in communication with said discharge conduit for distributing water from said water tank into said bowl when said flush valve is operated to flush said bowl, said accessary comprising an air duct for each toilet suitably connected into said overflow pipe, an electrically driven blower means having a suction side and a discharge side, an electrically operated air valve means for each toilet, said air valve means interconnecting the air duct and suction side of said blower, said air valve means being operable to reduce the air pressure within said overflow pipe, an electrical control means for each toilet operable to apply electrical power to said air blower and said air valve means, thus causing the air pressure within said overflow pipe to be reduced below atmospheric pressure, whereby odor laden air may be drawn in seriatim from said toilet bowl through said water distribution channel, said water discharge conduit, said overflow pipe, said air duct, said air valve means, and through said blower, said electrical control means operable so as to remove power from said blower, and close said air valve means, whereby the toilet is restored to conventional operation.

8. The accessary according to claim 7 together with a second part of said air valve means, said second part operable so as to vent the overflow pipe to the atmosphere, when the first part of said air valve means is closed.

9. The accessary according to claim 7 together with a vent means located between said air valve means and said overflow pipe, being capable of venting the overflow pipe to the atmosphere when said air valve is closed.

10. The accessary according to claim 7 together with a second electrical control means actuated by said flushing means, operable so as to remove power from said air blower, and close said air valve means, thus allowing the air pressure within the water tank to return to atmospheric pressure, whereby the toilet is restored to conventional operation.

11. The accessary according to claim 7 together with a second electrical control means actuated by an air sensitive actuator means, operable so as to remove power from said air blower, and close said air valve means, thus allowing the air pressure within the water tank to return to atmospheric pressure, whereby the toilet is restored to conventional operation.

* * * * *

UNITED STATES PATENT OFFICE

CERTIFICATE OF CORRECTION

Patent No. 3,942,200 Dated March 9, 1976

Inventor(s) Raymond H. Pearson

It is certified that error appears in the above-identified patent and that said Letters Patent are hereby corrected as shown below:

Column 9, line 7, "taken" should read -- laden --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*